US005108296A

United States Patent [19]

Takano et al.

[11] Patent Number: 5,108,296

[45] Date of Patent: Apr. 28, 1992

[54] MOUNTING AND GROUNDING CONNECTORS FOR ELECTRICAL COMPONENTS

[75] Inventors: Tsunesuke Takano; Kouichi Sinzawa; Hideaki Sakamoto, all of Tokyo, Japan

[73] Assignee: Daiichi Denso Buhin Co., Ltd., Tokyo, Japan

[21] Appl. No.: 736,239

[22] Filed: Jul. 26, 1991

[30] Foreign Application Priority Data

| | | | |
|---|---|---|---|
| Aug. 7, 1990 | [JP] | Japan | 2-83579[U] |
| Aug. 9, 1990 | [JP] | Japan | 2-84184[U] |
| Aug. 30, 1990 | [JP] | Japan | 2-91113[U] |
| Aug. 30, 1990 | [JP] | Japan | 2-91114[U] |
| Nov. 9, 1990 | [JP] | Japan | 2-118165[U] |

[51] Int. Cl.[5] ..... H01R 4/66; H01R 4/30

[52] U.S. Cl. ..... 439/92; 439/573; 439/801; 403/408.1

[58] Field of Search ..... 439/92, 97, 101, 572, 439/573, 801; 403/408.1

[56] References Cited

U.S. PATENT DOCUMENTS 3,271,058 9/1966 Anderson ..... 403/408.1

FOREIGN PATENT DOCUMENTS 63-82327 11/1986 Japan .

*Primary Examiner*—Gary F. Paumen

*Attorney, Agent, or Firm*—Nixon & Vanderhye

[57] ABSTRACT

A connector for mounting and grounding electrical components to an underlyuing electrically conductive support structure by a mounting screw includes an electrically insulating mounting block which defines at least one mounting hole. A bent, electrically conductive bus bar having upper and lower legs is operatively associated with the mounting block such that a terminal end portion of the lower leg extends from the mounting block so as to contact the mounting screw when the connector is mounted to the support structure. Thus, grounding of the bus bar to the support structure occurs through the mounting screw. A reinforcement ring may be provided for the mounting hole which is positionally retained therewithin by various structures. Thus, reliable mounting and grounding of an electrical component may be achieved by the connectors of this invention, while minimizing the risk that excessive tightening of the mounting screw will result in breakage of the mounting block in the vicinity of the mounting hole.

9 Claims, 8 Drawing Sheets

MOUNTING AND GROUNDING CONNECTORS FOR ELECTRICAL COMPONENTS

RELATED APPLICATIONS

This application is based for purposes of priority under 35 USC §119 upon Japanese Patent application Nos. 2-83579 filed Aug. 7, 1990; 2-84184 filed Aug. 9, 1990, 2-91113 filed Aug. 30, 1990; 2-91114 filed Aug. 30, 1990, and 2-118165 filed Nov. 6, 1990, the entire content of each being expressly incorporated hereinto by reference.

FIELD OF THE INVENTION

The present invention relates generally to connectors for electrical components. More specifically, the present invention relates to connectors that are employed to mount and ground an electrical component (such as an automotive dome lamp) to a painted surface of a electrically conducting support structure (e.g., a selected portion of an automobile body).

BACKGROUND AND SUMMARY OF THE INVENTION

Electrical components are conventionally grounded to painted surfaces of an electrically conducting support structure (e.g., an automobile body) by forming a hole in a selected portion of the support structure, and then attaching a lead wire from the electrical component to be grounded by means of a screw and lug assembly which cooperates with the hole. Attachment of a lead wire to an electrically conductive support structure using conventional screw and lug assemblies can, however, be quite tedious and labor-intensive (especially when the attachment location is not readily accessible). Furthermore, the presence of a lead wire can be bothersome since it is typically hidden by the mounting structures associated with the electrical component being grounded. As a result, the electrical component sometimes is not securely mounted to the support structure.

Another problem associated with mounting and grounding of electrical components to an electrically conducting support structure is that the mounting block of the electrical component (which is typically formed of a molded plastics material so as to be electrically insulating) sometimes cracks or is abraded in the vicinity of its mounting hole due to the force associated with tightening of the mounting screw used to attach the mounting block to the support structure. To overcome this problem, mounting blocks of electrical components have been provided with insert injection-molded reinforcement rings embedded in the plastics material around the individual mounting holes. However, the costs of insert injection-molded parts are typically quite high and therefore sometimes cost-prohibitive.

A relatively more affordable proposal to reinforce the mounting hole of a mounting block associated with an electrical component is to either press-fit or loosely fit a separate reinforcing ring into the individual mounting holes. However, in the case of press-fit reinforcing rings, a press-fitting tool is typically required thereby increasing both labor and equipment costs. On the other hand, in the case of a loose fit reinforcing ring, the reinforcing ring has a tendency to fall out of the mounting hole during assembly and/or mounting of the mounting block to the underlying support structure.

What has been needed in the art, therefore, is a mounting system for electrical components which not only effects secure mounting of the electrical component's mounting block to an electrically conducting painted support member, but also effects reliable grounding of the electrical component. It is towards attaining such an electrical mounting and grounding connector that the present invention is directed.

Broadly, the present invention relates to a combined mounting and grounding connector for electrical components whereby mounting of an electrically insulated mounting block of the electrical component may be reliably attached to an electrically conductive painted surface of an underlying support structure (e.g., a portion of an automobile's body) and grounding of the electrical component is achieved. In this regard, the connectors of the present invention include a bent bus bar having a lower leg section which is disposed parallel to the central axis of the mounting hole, and an upper leg section which is tightly sandwiched between the insulating body member of the electrical component and the painted surface of the electrically conducting support member.

Significantly, a terminal end portion of the bent bus bar protrudes from the electrical component's mounting block in opposition to the mounting screw used to attach the mounting block to the support structure so that the protruding terminal end portion first contacts an underneath surface of the mounting screw head when the latter is threaded into the support structure through the mounting hole in the mounting block. As a result, the bus bar bears a substantial amount of the force exerted by the mounting screw thereby minimizing the force exerted by the mounting screw that is borne by the mounting block. Thus, the risk of breakage of the mounting block in the vicinity of the mounting hole due to excessive force exerted by the mounting screw is significantly minimized (if not eliminated entirely). At the same time, electrical grounding is achieved through the mounting screw due to the electrical communication it establishes between the bent bus bar and the underlying electrically conductive painted support member.

Reinforcement of the mounting hole of the mounting block is provided according to the present invention by means of a reinforcement ring which is insertably received within the mounting hole and thus surrounds the shank of the mounting screw. Structures are provided to retain the reinforcement ring positionally within the mounting hole so that it does not fall out of the mounting hole during attachment of the connector to the underlying support structure.

For example, the reinforcement ring according to this invention may be frictionally retained within the mounting hole by providing an arcuate relief adjacent to the mounting hole which establishes a resilient web having a cam surface protruding into the mounting hole. Thus, when the reinforcement ring is inserted into the mounting hole, it will bear against the cam surface which causes the web to be resiliently radially displaced. The inherent resiliency of the web will therefore exert a responsive radially inward force against the reinforcement ring which frictionally retains the reinforcement ring within the mounting hole.

Alternatively, the terminal end portion of the bus bar may itself be bent inwardly (i.e., relative to the mounting hole) to an extent whereby it does not interfere with the shank of the mounting screw, but yet provides a positional stop against which an edge of the retaining ring will seat. As a result, the retaining ring will be positionally restrained by means of the inwardly bent terminal end portion. Furthermore, the lower leg of the bent bus bar may be angled inwardly relative to the mounting hole so that it forms a leaf spring which exerts a bias force against an exterior surface of the reinforcement ring thereby frictionally retaining the ring within the mounting hole.

Further aspects and advantages of this invention will become more clear after careful consideration is given to the detailed description of the preferred exemplary embodiments thereof which follow.

BRIEF DESCRIPTION OF THE DRAWINGS

Reference will hereinafter be made to the accompanying drawings wherein like reference numerals throughout the various FIGURES denote like structural elements, and wherein;

FIGS. 1A-1lD depict one embodiment of a connector according to this invention, where FIG. 1A is a cross-sectional elevational view showing the connector mounted to an underlying painted electrically conductive support structure, FIG. 1B is a bottom perspective view of the connector's mounting block, FIG. 1C is a cross-sectional bottom perspective view showing the bent bus bar positioned in the mounting block, and FIG. 1D is a cross-sectional plan view taken along the horizontal midplane of the mounting block;

FIG. 2A is a cross-sectional elevational view showing the connector mounted to an underlying painted electrically conductive support structure, FIG. 2B is a bottom perspective view of the connector's mounting block, FIG. 2C is a cross-sectional bottom perspective view showing the bent bus bar positioned in the mounting block and also showing the reinforcement ring during its insertion into the mounting hole, and FIG. 2D is a cross-sectional bottom perspective view showing the bent bus bar positioned in the mounting block and also showing the reinforcement ring completely seated within the mounting hole;

FIG. 3A is a cross-sectional elevational view showing the connector mounted to an underlying painted electrically conductive support structure, FIG. 3B is a bottom perspective view of the connector's mounting block, FIG. 3C is a cross-sectional bottom perspective view showing the bent bus bar positioned in the mounting block and also showing the reinforcement ring during its insertion into the mounting hole, and FIG. 3D is a cross-sectional bottom perspective view showing the bent bus bar positioned in the mounting block and also showing the reinforcement ring completely seated within the mounting hole;

FIG. 7A is a bottom perspective view of the mounting block, FIG. 7B is a cross-sectional bottom perspective view of the mounting block showing the bent cylindrical rod-shaped bus bar in position therein, and FIG. 7C is a cross-sectional plan view of the mounting block shown in FIG. 7A as taken along its horizontal midplane.

DETAILED DESCRIPTION OF THE PREFERRED EXEMPLARY EMBODIMENTS

Figure 1A:
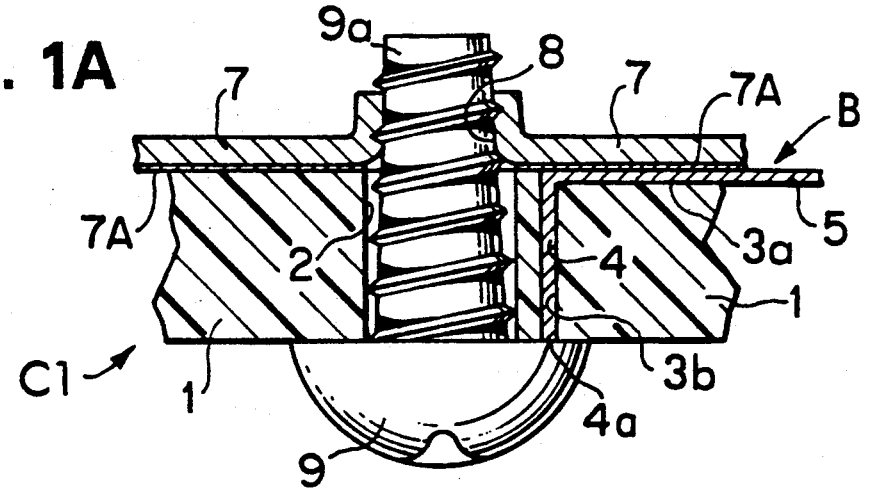
Figure 3A:
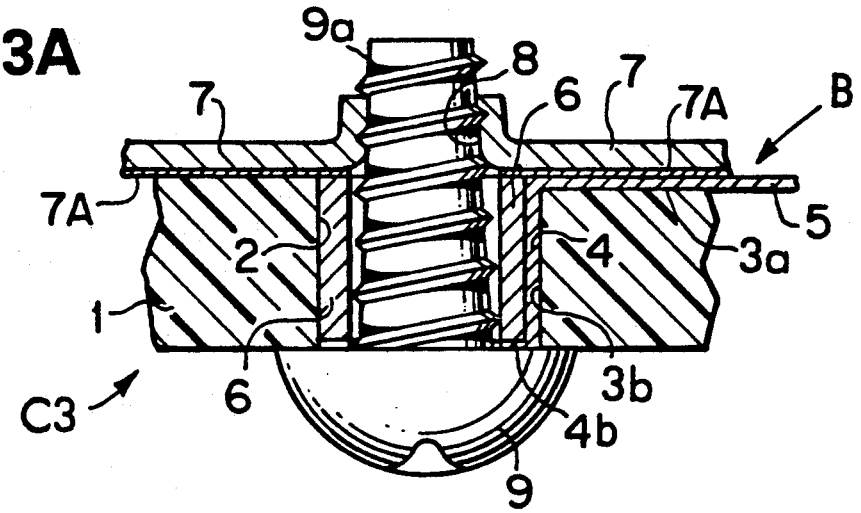
FIGS. 3A-3D depict another embodiment of the connector according to this invention where
Figure 1B:
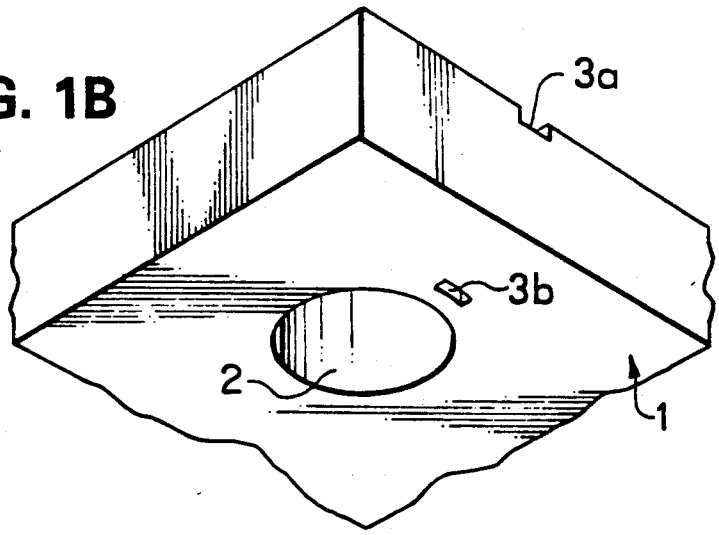
Figure 3B:
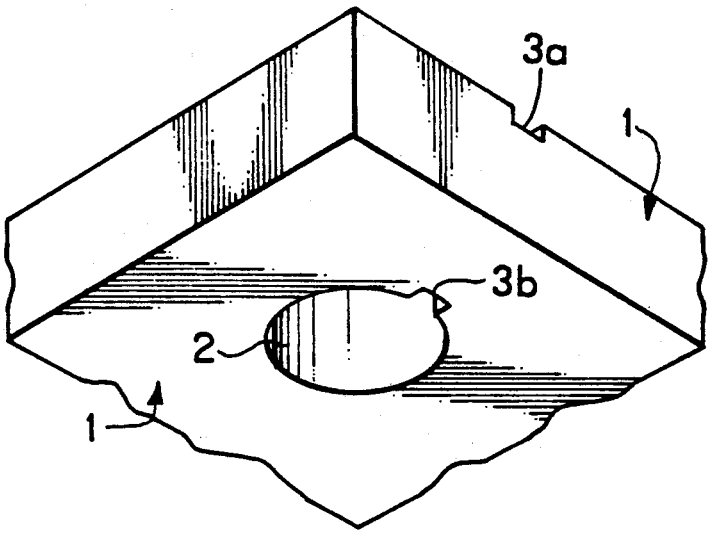
Figure 1C:
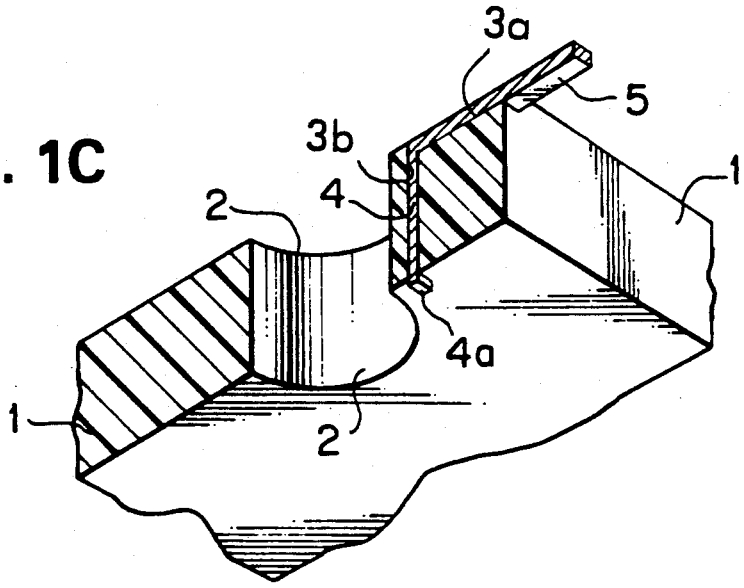

One preferred embodiment of a connector C1 according to the present invention is depicted in accompanying FIGS. 1A-1D. As is shown, the connector C1 includes a mounting block 1 preferably formed of an electrically insulating plastics material which defines a mounting hole 2 sized and configured to accept the shank 9*a* of a mounting screw 9 therewithin. The mounting block 1 also defines a recessed groove 3*a* in its upper surface support structure 7 (which in the embodiments to be described herein is sheet metal forming a portion of an automobile's body having a layer of paint 7A on its surface) and an aperture 3*b* which extends generally parallel to the longitudinal axis of the mounting hold 2.

An electrically conductive bus bar B is bent such that it has a lower leg 4 and an upper leg 5. The upper leg is received within the recessed groove 3*a* such that it is flush with the surface of the mounting block adjacent the support structure 7. The lower leg 4 is inserted within the aperture 3*b* prior to mounting the connector Cl onto the support structure 7. As is perhaps more clearly seen in FIG. 1C, the terminal end portion 4*a* of the lower leg 4 protrudes outwardly from the lower surface of the mounting block.

Figure 4A:
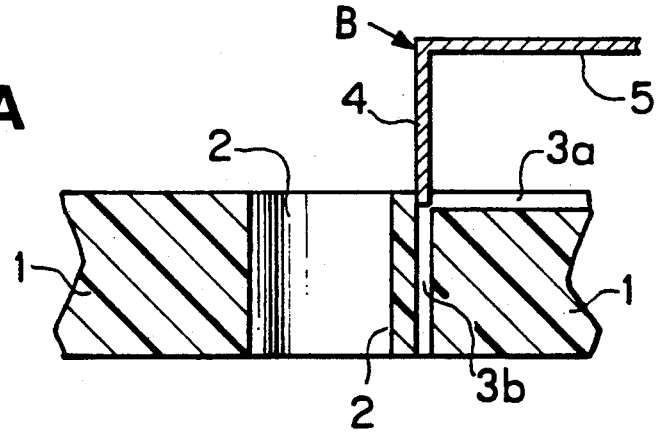
FIGS. 4A-4C are cross-sectional elevational views sequentially showing the manner in which the connector depicted in FIGS. 1A-1D is mounted onto an underlying support structure.
Figure 4B:
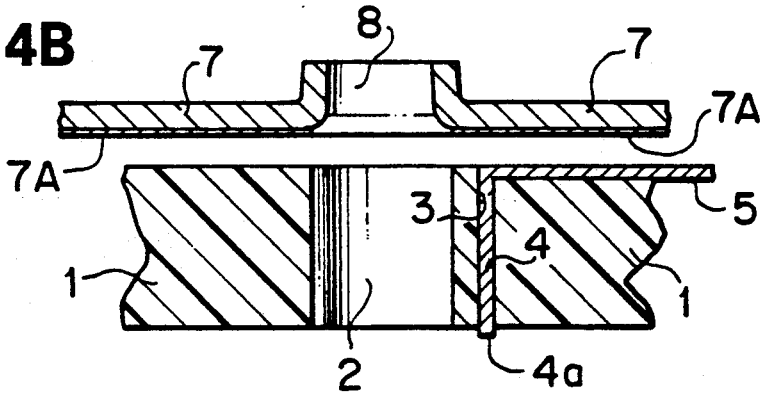
Figure 4C:
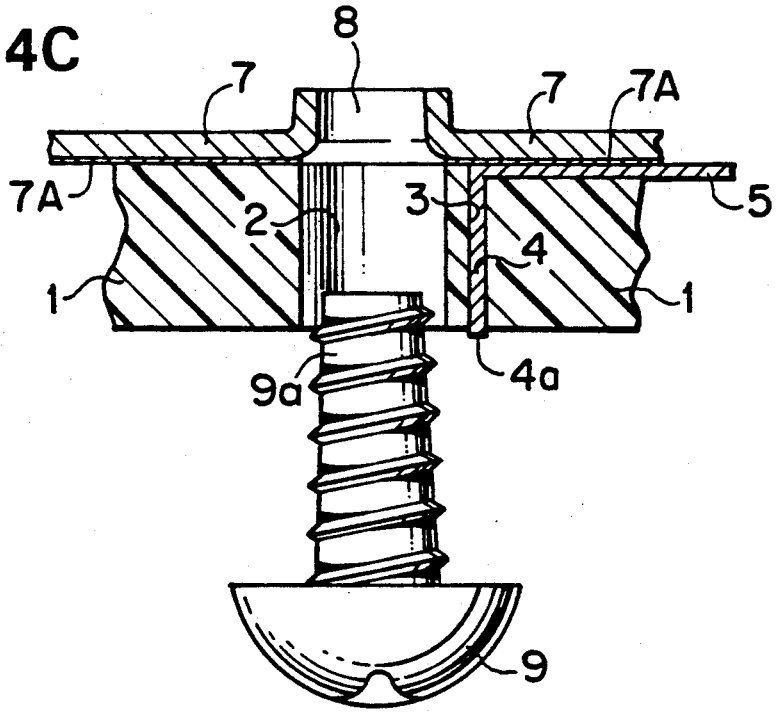

When the connector is to be mounted onto the support structure 7, the bent bus bar B will first be positioned in the mounting block 1 as shown in FIG. 4A such that the upper leg 5 is disposed within the groove 3*a* and the lower leg 4 is disposed within the aperture 3*b*. The mounting hole 2 defined in the mounting block 1 will then be aligned with a hole 8 previously formed in the support structure 7 by means of drilling or burring, for example, as shown in FIG. 4B. It will be appreciated that the process of forming the hole 8 will cause the paint layer in its vicinity to be scraped or removed thereby leaving only bare metal in the vicinity of the hole 8. Thereafter, as shown in FIG. 4C, the shank 9*a* of the screw 9 will be inserted through the mounting hole 2 of the mounting block 1 such that the threads on the shank 9*a* engage the bare metal forming the hole 8.

Preferably, the mounting screw 9 is a self-tapping sheet metal screw so that it positively "bites" into the metal forming the hole 8. As will also be appreciated, tightening of the screw 9 will cause the protruding terminal end portion 4*a* to come into positive contact with with the underneath surface of the screw head. Thus, when fully tightened, a path of electrical continuity will be established between the bus bar B and the electrically conductive support structure 7 by virtue of the screw 9 being in contact with the terminal end portion 4*a* at its head, and in contact at its shank with the bare metal of the support structure 7 defining the hole 8.

Furthermore, since the terminal end portion 4a of the lower leg 4 protrudes from the mounting block 1, the upper leg 5 will be forcibly captured between the mounting block 1 and the painted surface 7A of the support structure 7 when the screw 9 is fully tightened. Moreover, a significant amount of the force exerted by the screw 9 when fully tightened will be borne axially by the lower leg 4 thereby substantially preventing over-tightening of the screw and thereby minimizing the risk that the mounting block 1 will break in the vicinity of the mounting hole 2. Thus, the protruding terminal end portion 4a and the lower leg 4 will function so as to both establish positive electrical grounding contact with the screw 9 and reinforce the mounting hole 2.

Another connector C2 according to a modified embodiment of this invention is shown in accompanying FIGS. 2A–2D and is substantially similar to the connector C1 described above. One principal difference, however, is that the connector C2 is provided with a cylindrically tubular rigid reinforcement ring 6 which is accepted within the mounting hole 2 defined in the mounting block 1. In addition, the connector C2 is provided with structures which prevent the reinforcement ring 6 from falling out of the mounting hole 2 when the connector C2 is assembled and/or mounted tot he underlying support 7. As is shown especially in FIGS. 2B–2D, the mounting block 1 of connector C2 includes a camming member 10 which inwardly protrudes into the mounting hole 2. Preferably, the camming member 10 is arcuate (generally cylindrical) and is gradually tapered in the direction in which the reinforcement ring is to be inserted into the mounting hole 2. An arcuate relief slot 10a is formed in the mounting block 1 radially outwardly adjacent to the camming surface so as to establish an integral web 10b of plastics material therebetween. The web 10b will thus be capable of being radially outwardly displaced into the space formed by the arcuate relief slot 10a, and due to the inherent resiliency of the plastics material forming the mounting block 1 (and hence the web 10b integral therewith), the web 10b will have a tendency to return to its normal (i.e., non-displaced) condition.

Figure 2A:
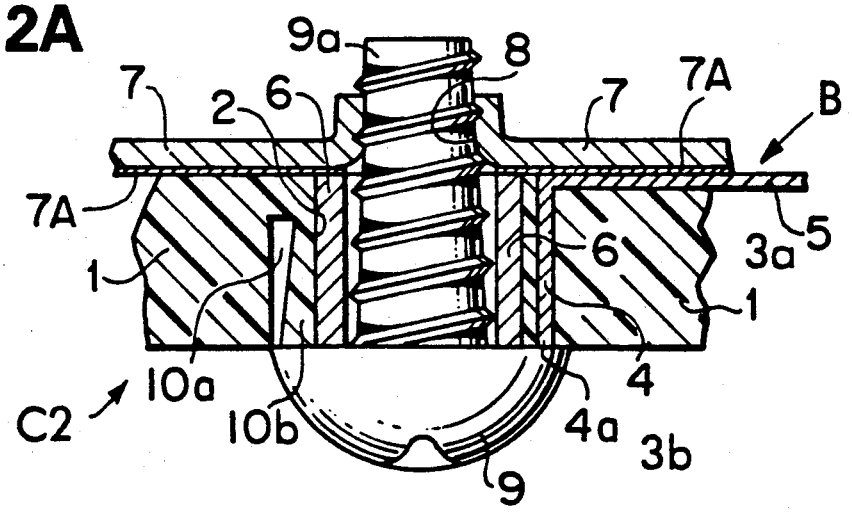
FIGS. 2A-2D depict another embodiment of the connector according to this invention where
Figure 2B:
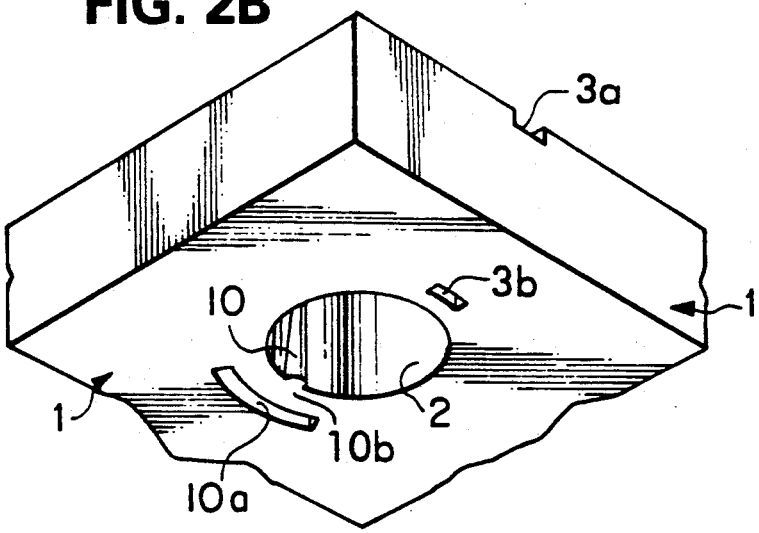
Figure 2C:
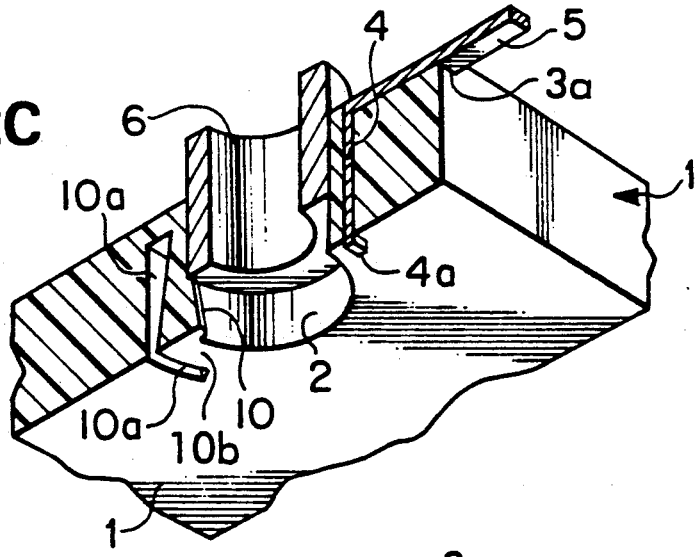
Figure 3C:
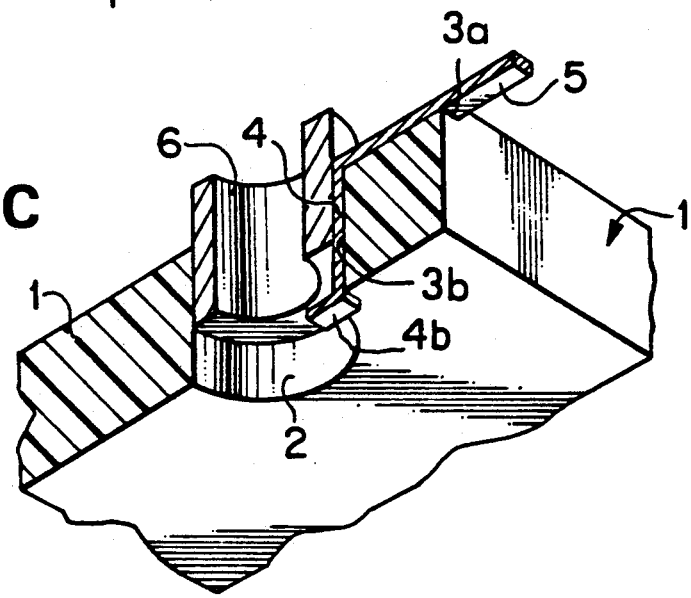
Figure 1D:
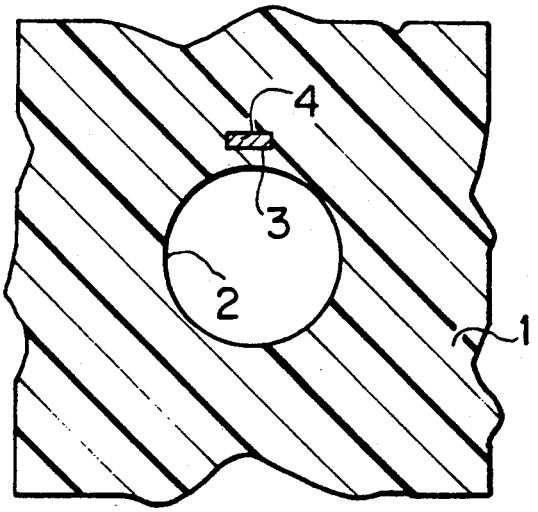
Figure 2D:
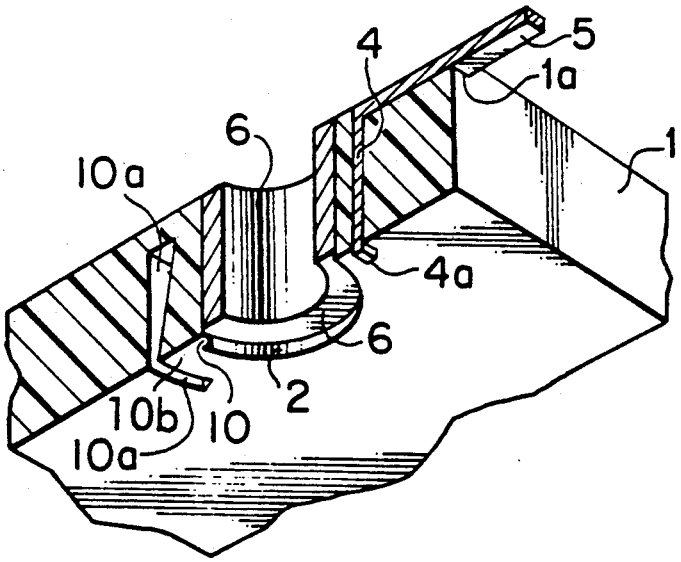
Figure 3D:
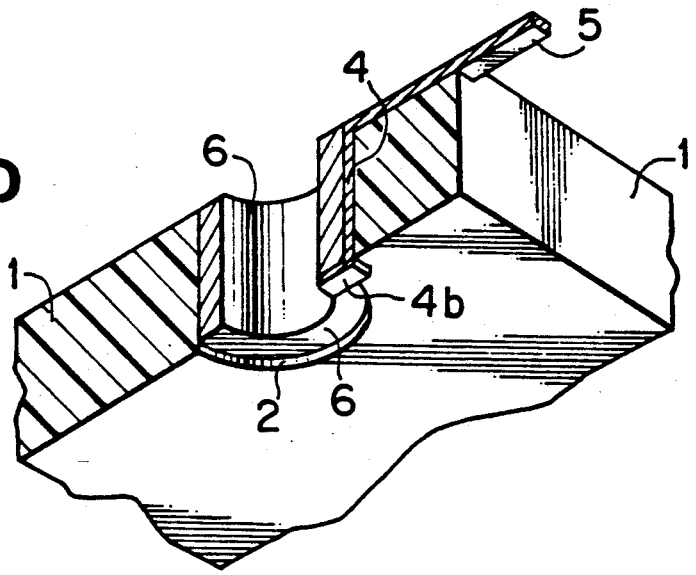

As is seen particularly in FIGS. 2C and 2D, when the reinforcement ring 6 is inserted into the mounting hole 2, a portion of the ring's exterior surface will come to bear against the camming member 10. Continued insertion of the ring 6 into the mounting hole 2 will thereby forcibly cause the web 10b to be displaced radially outwardly into the space provided by the arcuate relief slot 10a. The resiliency of the web 6 will therefore responsively exert a radially inwardly biased engagement force against the exterior surface of the ring 6 thereby frictionally retaining the reinforcement ring within the mounting hole 2.

The connector C3 shown in accompanying FIGS. 3A–3D is similar to the connector C2 described above in that a reinforcement ring 6 is inserted within the mounting hole 2 of the mounting block 1 and means are provided to retain the ring 6 therewithin. According to the embodiment of connector C2, however, the means to retain the reinforcement ring 6 within the mounting hole 2 is in the form of an inwardly bent (i.e., relative to the mounting hole 2) terminal end segment 4b of the lower leg 4. As is seen, for example, in FIGS. 3C and 3D, the inwardly bent terminal end segment 4b protrudes from the mounting block 1 in a manner similar to the terminal end portion 4a described previously with respect to FIGS. 1A–1D and thus provides similar functions. However, the bent terminal end segment 4b of connector C3 also provides a positional stop surface against which a lower edge of the reinforcement ring 6 will seat when fully inserted into the mounting hole 2 so as to prevent it from falling out of the hole 2 during assembly and/or mounting.

Figure 5:
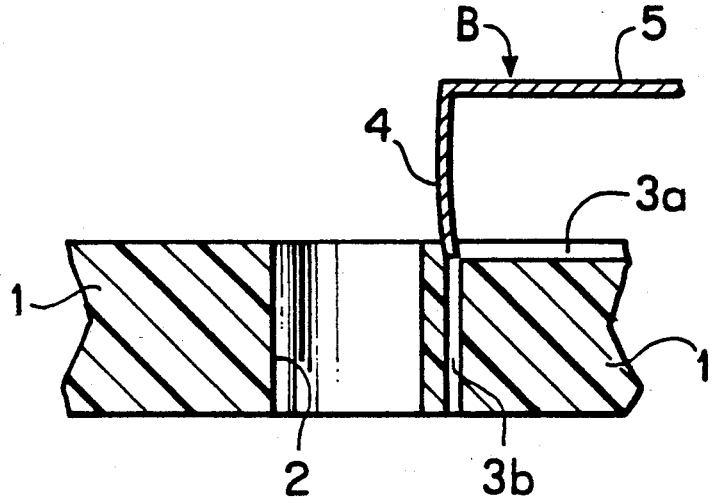
FIG. 5 is a cross-sectional elevational view of a modified form of the bent bus bar that may be employed in the connectors of this invention.

Although the bus bar B is essentially temporarily locked within the mounting block 1 due to its preferred rectangular cross-sectional configuration, the lower leg 4 may be fashioned so that it has a gentle arc between its upper and lower extents as shown in FIG. 5. As a result of its arcuate configuration, a greater amount of resiliency will be imparted to the lower leg 4 so that, when positioned within the aperture 3b, a spring-like engagement force will be exerted against the walls defining the aperture 3b. As a result, the bus bar will be resiliently coupled to the mounting block 1.

Figure 6:
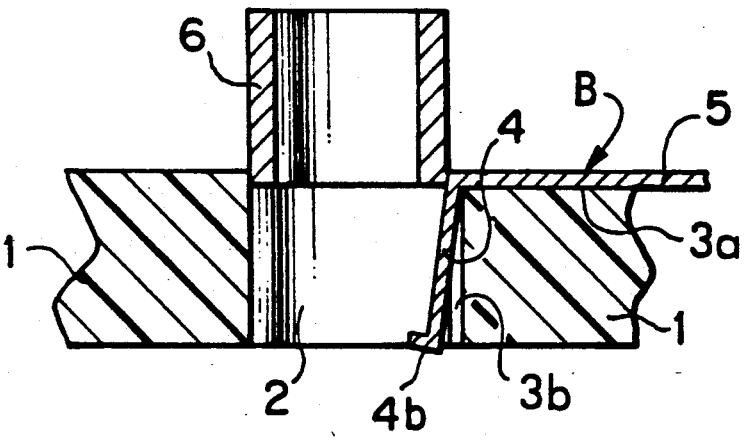
FIG. 6 is a cross-sectional elevational view of a modified form of a bent bus bar that may be employed in the connectors of this invention so as to frictionally retain a reinforcement ring within the mounting hole.

The lower leg 4 may also be inwardly angled so that it extends into the mounting hole 2 as shown in FIG. 6, in which case the aperture 3b is in the form of a key slot that is exposed to the mounting hole 2. The inward angle of the lower leg 4 thus creates a leaf-spring effect and is especially desirable when a reinforcement ring 6 is employed. That is, the leaf-spring effect of the angled lower leg 4 will exert a bias force against the reinforcement ring 6 when it is seated within the mounting hole 2 thereby fictionally retaining the ring 6 therewithin. Furthermore, the lower leg 4 may be provided with an inwardly bent segment 4b to provide a positional stop surface against which the lower edge of the ring 6 may abut thereby providing additional positional restraint against removal of the ring 6 from the mounting hole 2 in a manner similar to that already described.

Figure 7A:
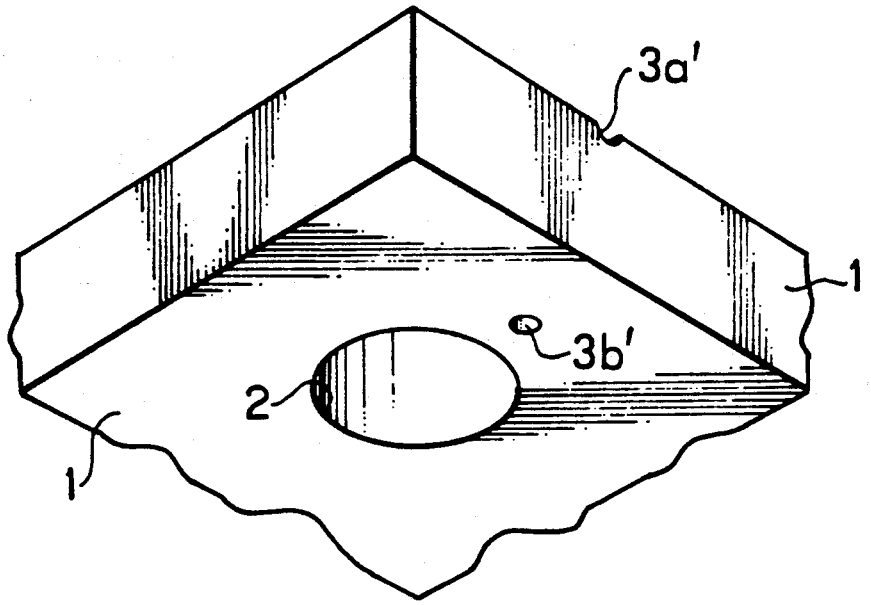
FIGS. 7A-7C depict an alternative embodiment of the connector according to this invention wherein the bent bus bar is in the form of a cylindrical rod, and where
Figure 7B:
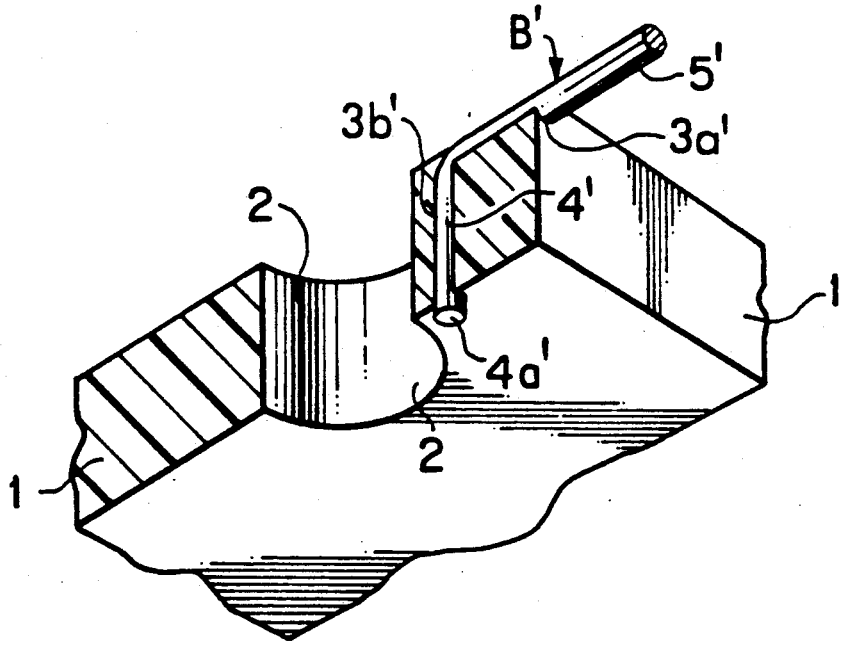
Figure 7C:
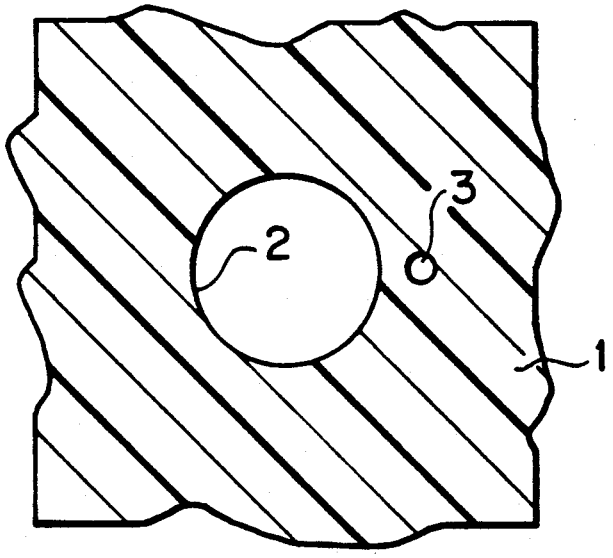

The bus bar B does not necessarily need to have a rectangular cross-section. Thus, as shown in FIGS. 7A–7C, the bus bar B' may be in the form of a bent cylindrical rod having lower and upper legs 4', 5', respectively. In this embodiment, the upper slot 3a' formed in the surface of the mounting block provides a saddle-type surface, whereas the 1 aperture 3b' has a circular cross-section corresponding to the size of the rod-shaped bus bar B' The lower leg 4' preferably has a protruding terminal end portion 4a' so as to provide similar functions to those already described above.

Figure 8:
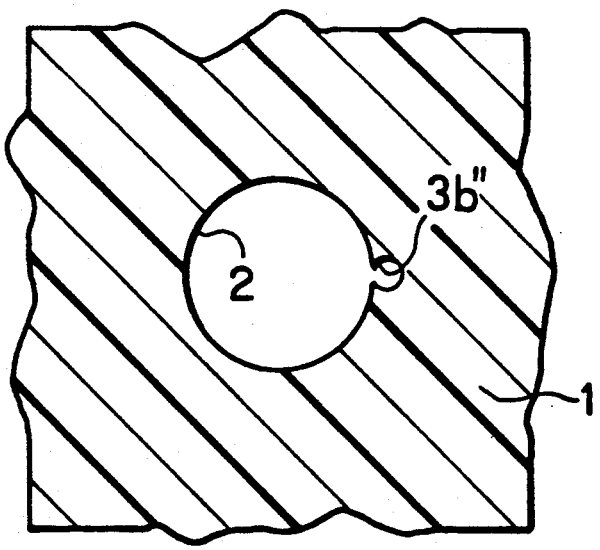
FIG. 8 is a cross-sectional view of another embodiment of a mounting block that may be employed in the connectors according to the present invention.

The lower leg 4' of the rod-shaped bus bar B' may be inwardly angled similar to the bus bar B described above with reference to FIG. 6, in which case a concave groove 3b'' which has a restrictive opening to the mounting hole 2 will be provided, as shown in FIG. 8. Thus, upon insertion of the reinforcement ring 6 (not shown in FIG. 8), the angled lower leg 4' will be forcibly "snap-fit" into the concave groove 3b'' thereby locking the lower leg 4' (and thus the bus bar B') therewithin.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A connector for mounting and grounding electrical components to an underlying electrically conductive support structure by means of a mounting screw having a head and a shank, said connector comprising a electrically insulating mounting block which defines at least one mounting hole; and an electrically conductive bus bar operatively associated with the mounting block; wherein said bus bar is bent to establish upper and lower legs;

said mounting block having a recessed groove in one surface sized and configured to receive said upper leg of said bus bar and an aperture sized receiving said lower leg such that said lower leg is oriented generally parallel to a central axis of said mounting hole;

said lower leg including a free end portion which, extends from said mounting block so as to contact the head of the mounting screw, wherein said mounting block is mounted to said support structure by the mounting screw received in the mounting hole, and electrical grounding is established between the support structure and the bus bar through the shank of the mounting screw by virtue of the terminal end portion of the lower leg being in contact with the head of the mounting screw.

2. A connector as in claim 1, further comprising a cylindrical reinforcement ring inserted within said mounting hole and surrounding the mounting screw shank.

3. A connector as in claim 2, which further comprises retaining means for positionally retaining said reinforcement ring within said mounting hole.

4. A connector as in claim 3, wherein said retaining means includes a camming member which protrudes inwardly into said mounting hole, and a relief slot formed in said mounting block adjacent to said camming member and establishing a web of said mounting block therebetween, wherein said web of said mounting block is resiliently displaced into said relief slot by said reinforcement ring, said web responsively exerting an inward bias force against said reinforcement ring, whereby said reinforcement ring is positionally retained within said mounting hole.

5. A connector as in claim 3, wherein said retaining means includes a bent segment of said terminal end portion which extends inwardly into said mounting hole, said bent segment providing a stop against which an edge of said reinforcement ring abuts when inserted into said mounting hole.

6. A connector as in claim 3 or 5, wherein said aperture is in the form of a key slot which is opened to the mounting hole, and wherein said retaining means is further provided by said lower leg of said bus bar being inwardly angled so as to provide a leaf-spring effect which exerts a bias force against said reinforcement ring, whereby said reinforcement ring is positionally retained within said mounting hole.

7. A connector as in claim 6, wherein said bus bar is in the form of a cylindrical rod.

8. A connector as in claim 1, wherein said bus bar is in the form of a cylindrical rod.

9. A connector as in claim 1, wherein said lower leg of said bus bar is accurately bent to provide a spring-like engagement force which locks said lower leg of said bus bar within said aperture.

* * * * *